US008851913B2

(12) United States Patent
Chobot et al.

(10) Patent No.: US 8,851,913 B2
(45) Date of Patent: Oct. 7, 2014

(54) ELECTRICAL CONNECTOR

(75) Inventors: Joseph Chobot, Morrisville, NC (US); Paul Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 253 days.

(21) Appl. No.: 13/452,122

(22) Filed: Apr. 20, 2012

(65) Prior Publication Data

US 2013/0280945 A1 Oct. 24, 2013

(51) Int. Cl.
*H01R 13/62* (2006.01)

(52) U.S. Cl.
USPC ..... 439/260; 439/611

(58) Field of Classification Search
USPC ..... 439/259–266, 611–619, 699.2
See application file for complete search history.

(56) References Cited

U.S. PATENT DOCUMENTS

| | | | | |
|---|---|---|---|---|
| 4,184,657 | A | 1/1980 | Jardine | |
| 7,427,212 | B2 * | 9/2008 | Hyun et al. | 439/495 |
| 7,527,510 | B2 * | 5/2009 | Yoo | 439/232 |
| 2012/0190227 | A1 * | 7/2012 | Ju et al. | 439/259 |

* cited by examiner

*Primary Examiner* — Khiem Nguyen
(74) *Attorney, Agent, or Firm* — Dennis J. Williamson; Moore & Van Allen PLLC

(57) ABSTRACT

A connector for a light source comprises a first cam having a contact surface that is mounted such that the contact surface is extended and retracted relative to the housing. An electrical contact is provided and positioned to contact an electrical terminal in the socket. A conductor is electrically coupled to the electrical contact where the conductor is connected to a light source. An actuator rotates the cam to the retracted position. The connector may be inserted linearly into the socket and the actuator released to mount the light source in the socket.

14 Claims, 11 Drawing Sheets

ELECTRICAL CONNECTOR

BACKGROUND

The invention relates to electrical connectors and more particularly to electrical connectors for light bulbs, lamps, light fixtures or other lighting systems. The lighting systems may comprise light emitting diode (LED) lighting systems, incandescent lights, fluorescent lights, halogen lights or the like. It is known to connect a lighting system to a socket using a variety of different styles of connectors including an Edison screw, a bayonet connector, a bi-pin connector, a wedge connector or the like.

SUMMARY OF THE INVENTION

A connector for a light source comprises a housing dimensioned to fit into an electrical socket. A first cam having a contact surface is mounted for movement relative to the housing such that the contact surface is extended and retracted relative to the housing. An electrical contact is mounted on at least one of the housing and the first cam positioned to contact an electrical terminal in the socket. A conductor is electrically coupled to the electrical contact where the conductor is connected to a light source.

The housing may be made of an electrically insulating material. A second cam having a second contact surface may be mounted for movement relative to the housing such that the second contact surface is extended and retracted relative to the housing. The second cam may be mounted 180 degrees from the first cam. The first cam may be mounted in the housing for pivoting motion about an axis where the contact surface may be eccentric relative to pivot axis such that when the first cam pivots in a first direction the contact surface extends progressively farther away from the housing. A biasing mechanism that biases the contact surface in the first direction may be provided. An actuator for rotating the cam in a second direction opposite to the first direction may be provided. The electrical contact may be formed as a pad of electrically conductive material that is secured to the cam and forms all or part of the contact surface. A second electrical contact may be supported by the housing and positioned to contact a second electrical terminal on the socket. A biasing mechanism may be provided biasing the second electrical contact away from the housing. A second conductor electrically may be coupled to the second electrical contact where the second conductor may be connected to the light source. The first conductor may be connected to the light source by a pigtail. The first conductor may be connected to a bulb integrated with the connector.

A connector for a light source comprises a first cam arm supporting a first contact surface and a second cam arm supporting a second contact surface connected to the first cam arm at a hinge for movement relative to the first cam arm such that the first contact surface and the second contact surface may be extended and retracted relative to one another. An electrical contact is mounted on at least one of the first contact surface and the second contact surface positioned to contact an electrical terminal in the socket. A conductor is electrically coupled to the electrical contact where the conductor is connected to a light source.

The first cam arm, the second cam arm and the hinge may be formed of elastic material. The hinge may be a living hinge where the first cam arm and the second cam arm are biased to an extended position by the elastic material. The first cam arm, the second cam arm and the hinge may be formed of a single-piece of elastic material. An actuator may rotate the cam arms where the actuator may be formed of the single piece of elastic material with the first cam arm, the second cam arm and the hinge. A second electrical contact may be positioned to contact a second terminal in the socket and be biased to an extended position by a portion of the elastic material. The first contact surface and the second contact surface may define at least a portion of a cylinder.

A method of mounting a light fixture in a socket comprises providing a connector connected to a light fixture, the connector including a cam movable between a retracted position and an extended position, the connector having at least one electrical contact positioned for contacting a terminal in the socket, an actuator for rotating the cam to the retracted position and a biasing mechanism for biasing the cam to the extended position; manipulating the actuator to move the cam to the retracted position; inserting the connector linearly into the socket; and releasing the actuator.

DETAILED DESCRIPTION OF PREFERRED EMBODIMENTS OF THE INVENTION

Figure 1:
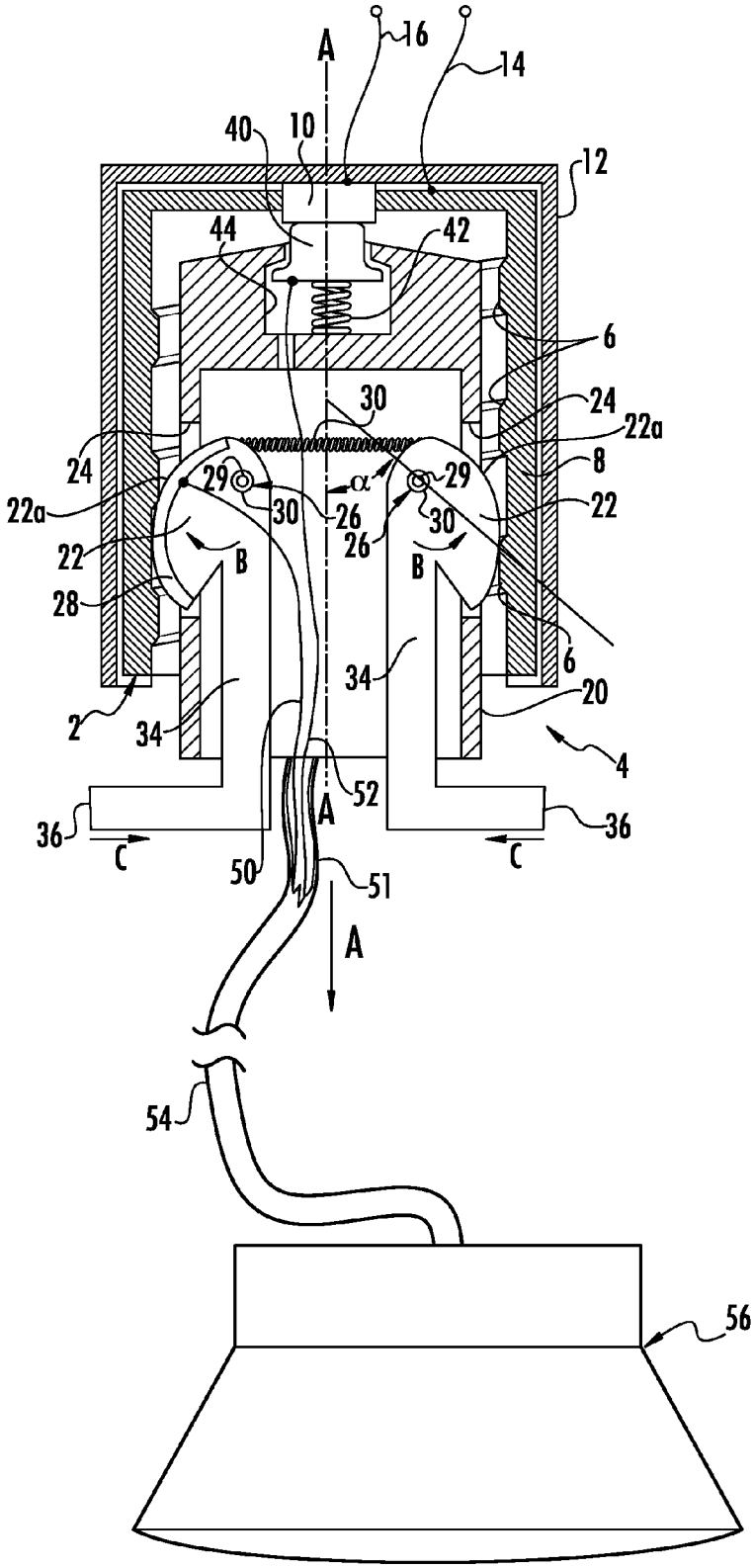
FIG. 1 is a partial section view of the connector of the invention connected to a light fixture and mounted in an exemplary socket.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like references numbers are used to refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The electrical connector of the invention may be used with light sources such as light bulbs, lamps, lights, light fixtures or the like that connect to a socket. The electrical connector may form part of the light source such as in existing light bulbs having Edison screws or the electrical connector may form part of a light fixture where the electrical connector is connected to the light source by external wires, pigtail, cable or other electrical connector. The electrical connector may be used with light emitting diode (LED) lighting systems, incandescent lights, fluorescent lights or halogen lights or the like. The connector may also be used with a socket other than a standard Edison screw socket such as a bayonet connector, a bi-pin connector, a wedge connector or the like. As used herein the term "light fixture" means any type of lamp, bulb, light or lighting system that may be used with the electrical connector including, but not limited to, standard light bulbs where the electrical connector and bulb are rigidly connected to one to form an integrated assembly and/or lighting systems that use an external pigtail type connection and may comprise any lighting technology including, but not limited to, incandescent lights, light emitting diode (LED) lighting systems, fluorescent lights, halogen lights or the like. The term "socket" as used herein means any type of socket having a wall that may be engaged by the electrical connector including, but not limited to, an Edison screw socket, a bayonet connector socket, a bi-pin connector socket, a wedge connector socket or the like.

For explanatory purposes the structure, use and operation of the electrical connector of the invention is shown and described herein in conjunction with an Edison screw socket. The Edison screw socket is a standard electrical lighting connector and is used widely throughout the world; however, the Edison screw can present a shock hazard because of the exposed energized surfaces. Moreover, installation of a light fixture having an Edison screw can be time consuming because each light must be threaded into the socket. In many applications, such as the installation of lighting in a new building, where numerous light fixtures must be installed, the cumulative time spent installing the light fixtures may be significant.

An embodiment of the electrical connector is shown generally at 4 in FIG. 1 used in conjunction with a standard Edison screw socket 2. In the illustrated embodiment the socket 2 comprises a standard Edison screw socket having internal screw threads 6 that would normally be engaged by the external screw threads associated with a light bulb. In a standard Edison screw socket the socket comprises a cylindrical receptacle 8 having an internal wall that includes the internal threads 6 and that is typically made of an electrically conductive material. The threaded receptacle 8 functions as a first terminal that is normally in electrically conductive contact with the threaded portion of a bulb's Edison screw. In some Edison screw sockets the first terminal may be a separate conductive element secured to the internal threaded wall of the receptacle 8, rather than being the entire socket wall. The socket 2 typically comprises a second terminal 10 that is located at the base of the receptacle 8 that is normally in electrically conductive contact with a contact located at the distal end of the threaded portion of a bulb's Edison screw. The socket 2 is typically surrounded by suitable insulators 12 that may comprise ceramic, plastic or the like or combinations of such insulators. The first terminal, receptacle 8, is connected to a conductor such as a wire 14 and the second terminal 10 is connected to a conductor such as a wire 16 where the wires supply electricity to the socket 2 from a power source such as the electrical power grid of a building.

The electrical connector 4 comprises a housing 20 that is dimensioned to fit within the interior space of socket 2. Because an Edison screw socket is cylindrical it may be convenient to make the housing 20 having a generally cylindrical shape with a diameter slightly smaller than the diameter of the socket; however, the housing 20 may have other shapes and in applications where the socket has a shape other than cylindrical it may be more convenient to make the housing with a corresponding outer shape. The housing 20 is preferably constructed of an electrically insulating material such as ceramic, plastic or the like.

A pair of cams 22 are mounted in the housing 20 for pivoting motion about axes 26. The cams have eccentric contact surfaces 22*a* that face the interior wall of socket 2. The cams 22 may extend through slots 24 or other apertures in the housing 20 such that the cams 22 extend to the exterior of the housing 20 where they may engage the interior wall of the socket 4. The pivot axes 26 may comprise pins 29 that are fixed in the housing and that extend through apertures 30 formed in the cams to create a hinge connection between the housing 20 and cams 22; however, any pivot connection that allows the cams 22 to pivot relative to the housing 20 may be used. At least one of the cams 22 is provided with an electrically conductive contact 28 that is arranged such that the contact 28 contacts the electrically conductive interior wall of the socket 2. In the illustrated embodiment the contact 28 is formed as a pad of electrically conductive material that is secured to the cam 22 and forms all or part of the eccentric contact surface 22*a* of the cam 22; however, the entire cam 22 may be made of an electrically conductive material. In the illustrated embodiment, only one of the cams 22 is formed with the contact 28; however, both of cams 22 may be formed with an electrically conductive contact 28. The cams 22 may be positioned 180 degrees from one another such that the cams 22 exert opposing forces on the socket 2 as will hereinafter be explained. While two cams 22 are shown a greater or fewer number of cams 22 may be used if desired.

The contact surface 22*a* of each cam 22 is eccentric relative to pivot axis 26 such that as the cam pivots in a first direction (arrow B, FIG. 1) about axis 26 the contact surface 22*a* extends progressively farther from housing 20 and toward the wall of the socket 2 and as the cam pivots in a second direction about axis 26 (opposite arrow B, FIG. 1) the contact surface 22*a* retracts progressively toward housing 20 away from the wall of the socket 2. The cams 22 are biased by a biasing mechanism 30 such that the contact surfaces 22*a* of the cams 22 are biased toward the extended position. In the illustrated embodiment the biasing mechanism 30 comprises a tension spring that is connected between the cams 22 to pull the cams to the extended position; however, a compression spring that pushes the cams to the extended position may also be used. Moreover, an individual biasing mechanism may be used with each cam. Any suitable biasing mechanism may be used to bias the cams to the extended position.

The cams 22 are operatively connected to lever arms 34 such that when the lever arms are pivoted the cams 22 are also pivoted about axes 26. The lever arms 34 may be made of an electrically insulating material such as plastic or ceramic to electrically insulate the electrical path created between contact 28 and the socket 2 from the user. The lever arms 34 are operatively connected to actuators 36 disposed such that the actuators are accessible to the user. The actuators 36 may be made of an electrically insulating material such as plastic or ceramic to electrically insulate the electrical path created between contact 28 and the socket 2 from the user. In the illustrated embodiment the lever arms 34 have an L-shape where one leg of the lever arm 34 extends to the exterior of the connector 4 where it forms actuator 36. Actuators 36 may be squeezed by the user, in the direction of arrows C, to release the connector 4 from the socket 2. In one embodiment, the lever arm 34, cam 22 and actuator 36 are formed of a single piece of material; however, these components may be separate components that are operatively connected to one another and may comprise additional intervening components. For example, the actuator 36 may be operatively connected to the lever arm 34 via a spring, linkage or the like such that movement of the actuator is transmitted to the lever arm. Similarly, the lever arm 34 may be operatively connected to the cam 22 via a spring, linkage or the like such that movement of the actuator is transmitted to the lever arm. Moreover, the actuators 36 may be operatively connected directly to the cams 22.

When the actuators 36 are depressed, the lever arms 34 pivot about hinges 26 to rotate the cams 22 to the retracted position against the bias of the biasing mechanism 30. The cams 22 are shaped and dimensioned such that in the retracted position the cam surfaces 22*a* will not contact the interior wall of socket 2 and a clearance gap is created between the cams 22 and the socket 2. In the extended position the cams 22 are biased into contact with the interior wall of the socket 2.

Upon the release of the actuators 36, the biasing mechanism 30 urges the cams 22 toward their extended position and urges the cam surfaces 22*a* into contact with the interior wall of the socket 2 as shown in FIG. 1. Any force exerted on the connector 4 in a direction tending to pull the connector out of the socket 2 (arrow A) increases the jamming force between the cams 22 and the interior wall of the socket 2 because the cams will be rotated in the direction of arrows B. When the cams rotate in the direction of arrow B the contact surfaces 22*a* of the cams extend away from the housing 20 to increase the pressure on the socket wall. To release the connector 4, the application of a small inward force on the actuators 36 (arrows C) releases the frictional force between the cams 22 and the wall of the socket 2 such that the levers 34 may be rotated to pivot the cams 22 to their retracted position and allow the connector 4 to be withdrawn from the socket 2.

The cam surfaces 22*a* of the cams 22 are shaped such that no matter what the diameter of the socket, within the maximum and minimum diameters for which the connector is designed, the contact point on the cam surfaces with the walls of the socket has a constant angular relationship a with respect to the longitudinal axis A-A of the housing. The line of action through the contact point between the cam surfaces 22*a* and the socket 2 and the pivot 26 is preferably less than 78 degrees to the longitudinal axis A-A. This ensures that the cams 22 will not slip out of the socket when a force in the direction of arrow A is applied to the connector. An angle of approximately 76 degrees is preferred.

A second electrical contact 40 is located at the distal end of the housing 20. The second contact 40 is made of an electrically conductive material. The second contact 40 is biased to an extended position away from the housing 20 by biasing mechanism 42. In one embodiment the second contact 40 comprises a push button made of electrically conductive material having a relatively flat pad that may electrically contact terminal 10 of socket 2. The contact 40 is trapped in a bore 44 formed in the housing 20 such that the second contact 40 may move along axis A-A but is trapped in the housing. The biasing mechanism 42 may comprise a compression spring trapped between the housing 20 and the second contact 40, although any suitable biasing mechanism may be used. A force may be exerted against the bias of the spring 42 that will move the second contact 40 toward the housing 20. Biasing the second contact 40 away from housing 20 ensures that good electrical contact between the contact 40 and the terminal 10 of the socket is provided and accommodates variations in the depth of insertion of the connector 4 in the socket 2.

A first electrical conductor 50 is connected to the first electrical contact 28 and a second electrical conductor 52 is connected to the second electrical contact 40. In the embodiment of FIG. 1 the first electrical conductor 50 and the second electrical conductor 52 may be wires that form a pig tail 54 that is connected to a light source 56 to create a lighting system. The first and second conductors 50 and 52 may be encased in suitable insulating sheathing 51 to form a cable, wire, cord or the like as is known. In one preferred embodiment the light source 56 comprises an LED lighting system although any lighting technology may be used. In use the connector 4 is inserted into a socket 2 and the light source 56 may be mounted in a ceiling as a recessed light or is otherwise mounted remotely from the socket.

Figure 2:
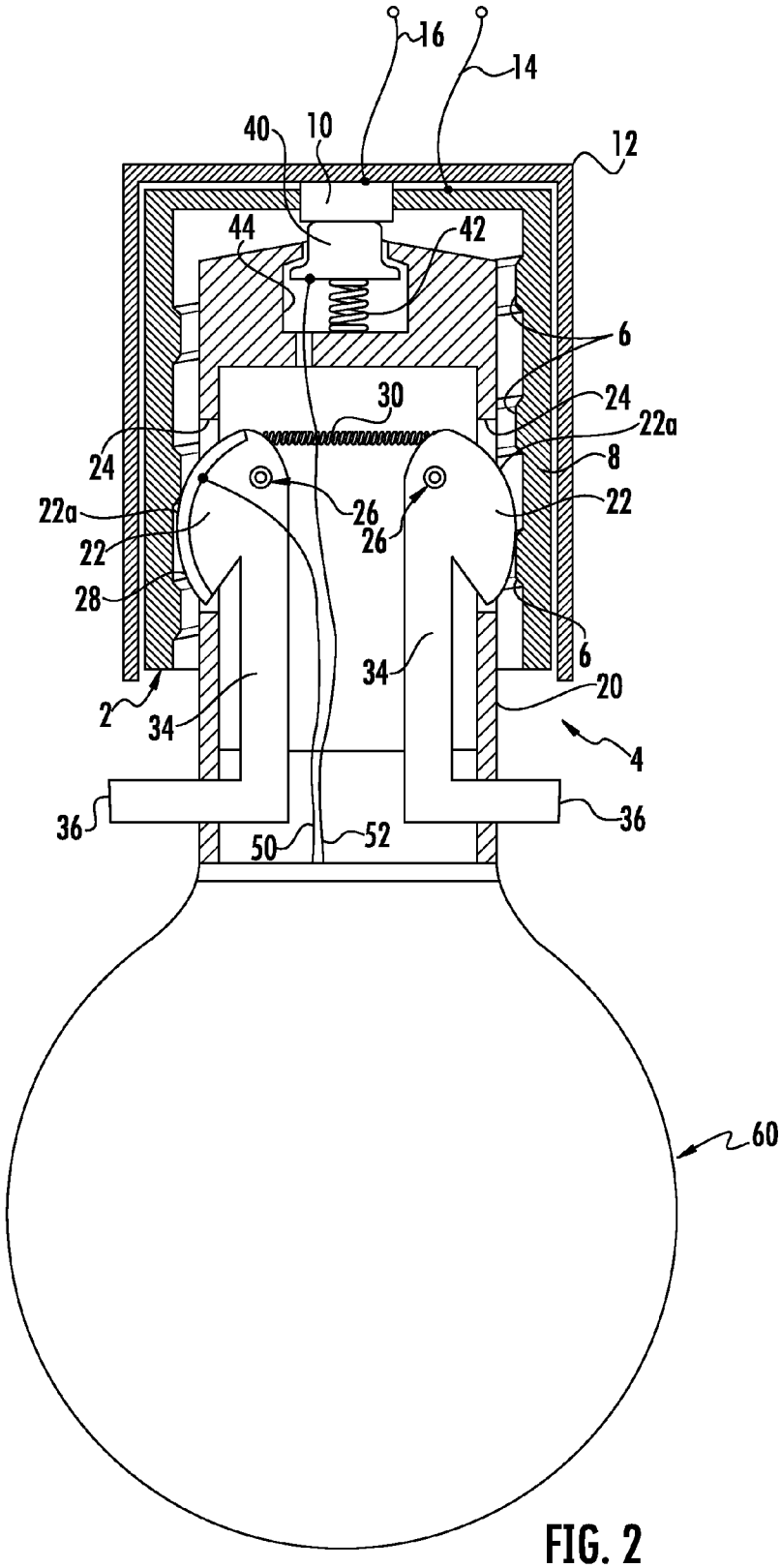
FIG. 2 is a partial section view of the connector of FIG. 1 in an integrated light bulb and mounted in an exemplary socket.

In the embodiment of FIG. 2 the connector 4 of FIG. 1 is attached to a light source 60 without an external pigtail. In this embodiment the light source 60 may comprise a bulb. In this embodiment the light source 60 is fixed to the connector 4 with the conductors 50 and 52 extending to the light producing element in light source 60 without an external pigtail. The light element may be an LED package, incandescent element, or other light producing element. In the embodiment of FIG. 2 intervening elements may be disposed between the connector 4 and the light source 60 such as heat sinks, power supplies or the like. The embodiment of FIG. 2 is configured to replace a standard Edison screw light bulb that may be used with a standard Edison screw socket. The embodiment of FIG. 2 is referred to herein as an "integrated" light fixture.

Figure 3:
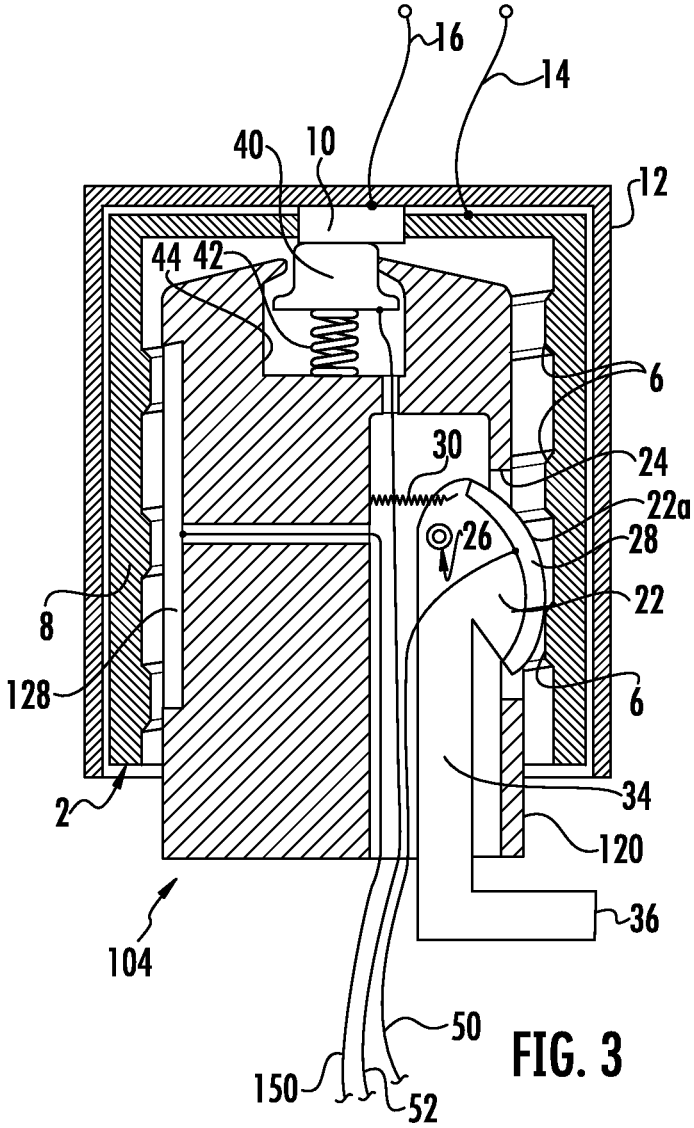
FIG. 3 is a partial section view of an alternate embodiment of the connector of FIG. 1 mounted in an exemplary socket.

Referring to FIG. 3 an alternate embodiment of the connector of the invention is disclosed. The embodiment of the connector 104 shown in FIG. 3 is similar to the embodiment of the connector 4 shown in FIGS. 1 and 2 except that a single cam 22, lever 34 and actuator 36 are provided. The biasing mechanism 30 is connected between the cam 22 and the housing 120 to bias the cam 22 to the extended position as previously described. When the connector 104 is inserted into a socket 2, the cam 22 forces the exterior wall of the housing 120 opposite to the cam 22 against the interior wall of the socket 2. The cam 22 operates in the same manner as previously described to secure the connector 104 in the socket 2. An electrical contact 28 may be formed on or by the cam 22 as previously described. An electrical contact 128 may also be formed on the exterior wall of the housing 120 opposite to the cam 14 such that the contact 128 is forced into electrical contact with the interior surface of socket 2 by the cam 22. Moreover, both contacts 28 and 128 may be used, one on the cam 22 and one on the wall of the housing 120, if desired. The contacts 28 and 128 may be connected to electrical conductors 50 and 150. The second electrical contact 40 is arranged as previously described and is connected to conductor 52. The connector 104 may be used with a pigtail type lighting system as shown in FIG. 1 or with an integrated bulb type lighting system as shown in FIG. 2.

Figure 4:
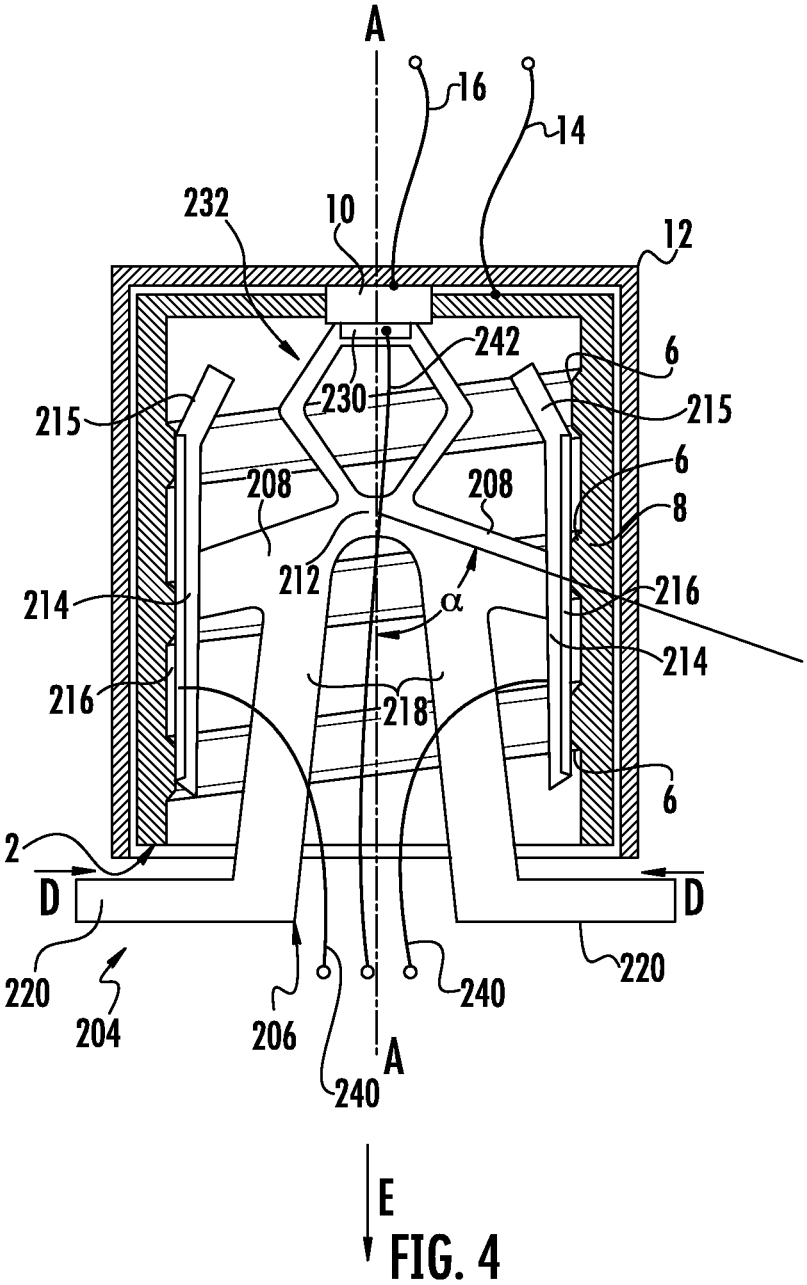
FIG. 4 is a side view of another embodiment of the connector of the invention mounted in an exemplary socket.

Another embodiment of the connector of the invention is shown in FIG. 4. The connector 204 comprises a deformable body 206 made of an elastic material. The connector body 206 may be made of plastic or similar deformable electrically insulating material and may be made by molding, extrusion or the like. The connector body 206 may be made as a single piece of material although the body may be manufactured as separate components that are secured to one another to form the deformable body. The body 206 comprises two cams each comprising a cam arm 208 and a plate 214. The cam arms 208 connected together at a hinge 212. The arms 208 extend 180 degrees from one another such that the cam arms 208 exert opposing forces on the socket 2. In the embodiments where the body 206 is made of elastic material the hinge 212 may comprise a living hinge and the elasticity of the material may be used as the biasing mechanism to bias the arms 208 to the extended position. The living hinge may be replaced by a mechanical hinge that connects the two cam arms 208 with a separate biasing mechanism; however, using a one-piece elastic body with a living hinge may be a more cost effective configuration.

Connected to the distal ends of each cam arm 208 are plates 214 that provide a contact surface for engaging the interior walls of the socket 2. The leading ends 215 of the plates 214 may be slanted inward to create beveled faces that facilitate the insertion of the connector in the socket. The ends 215 are angled such that the when the beveled faces contact the edges and/or sides of the socket the cams are forced to a retracted position. Electrical contacts 216 are provided on one or both of the plates 214 that make electrical contact with the interior surface of socket 2. A lever arm 218 is connected to each cam arm 208 that terminates in actuators 220 such that when a user squeezes the actuators 220 toward one another (arrows D) the movement of the lever arms 218 is transmitted to the cam arms 208 such that the cam arms pivot relative to one another at hinge 212 and are retracted toward one another. To release the connector 204, a small force on the actuators releases the frictional force between the plates 214 and the interior wall of the socket 2 such that the levers 218 may pivot the cam arms 208 about hinge 212 to retract the plates 214 and allow connector to be withdrawn from the socket 2. Because the body 206 is deformable the arms 208 may pivot about the living hinge 212 formed between the arms. When the actuators 220 are released, the elasticity of the material of the body 204 returns the arms 208 to the extended position.

The cam arms 208 are shaped such that, within the minimum and maximum working diameters, the distribution of forces (specifically the transmission of any pulling force onto the sidewall of the socket) is sufficiently similar to the previous embodiments such that the device operates on the same principle as a constant-angle cam. Any force exerted on the connector 204 in a direction tending to pull the connector out of the socket (arrow E) increases the jamming force between the cam arms 208 and the interior wall of the socket because the arms will tend to spread. As the arms spread the force exerted by the arms on the walls of the socket increases.

Located at the distal end of the body is a second contact 230 made of an electrically conductive material. The second contact 230 is biased to an extended position by biasing mechanism 232. In one embodiment the biasing mechanism 232 comprises a portion of the body 204 formed so as to be able to deform toward the hinge 212 and return elastically to the extended position. An additional biasing mechanism such as a spring may also be used; however, using the elastic material of the body to form the biasing mechanism and create the spring force may be the most cost effective embodiment. A force may be exerted against the bias of the biasing mechanism 232 to move the second contact toward the hinge 212 such that the biasing mechanism 232 provides good contact between the contact 40 and the terminal 10 of the socket and accommodates variations in the depth of insertion of the connector in the socket 2.

A first electrical conductor 240 is connected to the first electrical contacts 216 and a second electrical conductor 242 is connected to the second electrical contact 230. The first electrical conductor and the second electrical conductor may form a pig tail that is connected to a light source to create a lighting system as shown in FIG. 1. In one preferred embodiment the light source is an LED light although any lighting technology may be used. In use the connector is inserted into a socket and the light source may be mounted in a ceiling or other structure remote from the socket.

Figure 5:
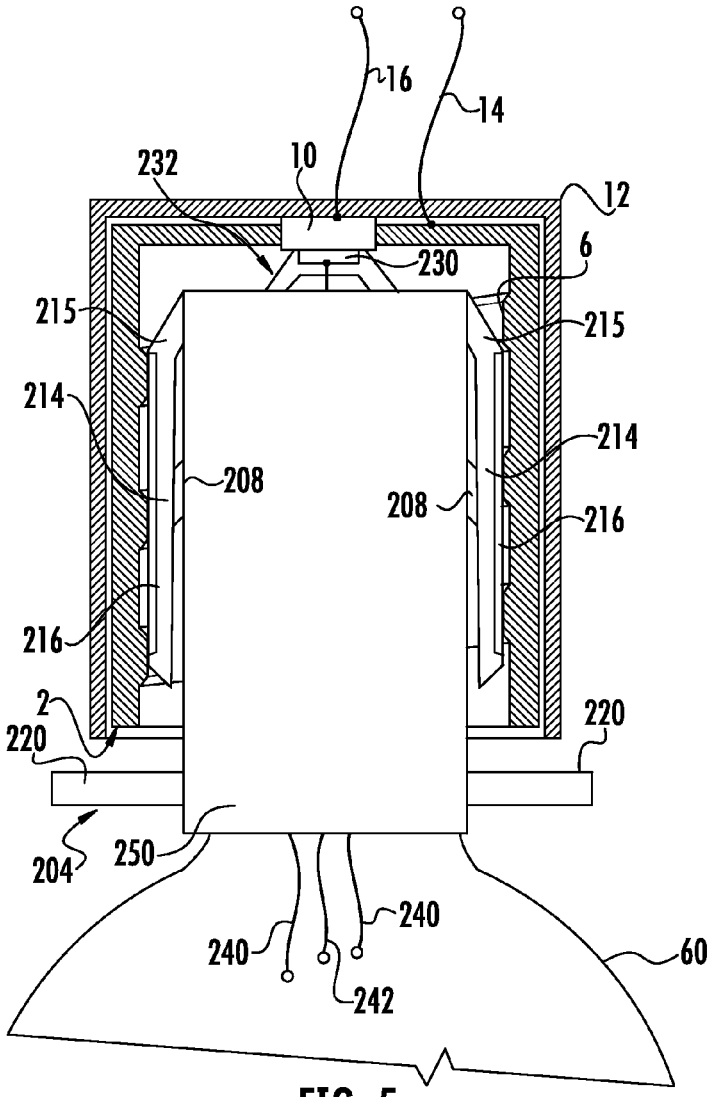
FIG. 5 is a side view of yet another embodiment of the connector of FIG. 4 mounted in an exemplary socket.
Figure 6:
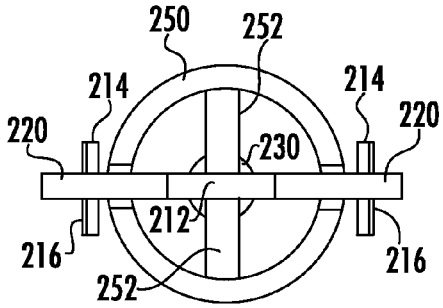
FIG. 6 is a top view of the connector of FIG. 5.

Alternatively, the connector of FIG. 4 may be attached to a light source without the pigtail connection as shown in FIG. 5 to create an integrated light fixture. The light source may comprise a bulb 60 in this embodiment. To integrate the connector 204 with a bulb 60 the connector 204 may be mounted in a housing 250 to provide a mounting structure for the bulb. The bulb 60 may be attached to the housing 250 as shown in FIG. 5 and as described with reference to FIG. 2. The cam arms 208 may extend through slots or apertures formed in the housing 250. The housing 250 may be secured to the connector 204 by supports 252 that connect the housing to the connector 204 in the area of hinge 212 as shown in FIG. 6. In this embodiment the light source 60 is fixed to the connector 4 with the conductors 240 and 242 extending to the light producing element in light source without an external pigtail. The light element may be an LED package, incandescent element, or other light producing element. Intervening elements may be disposed between the connector 204 and the light source 60 such as heat sinks, power supplies or the like. This embodiment may be used to replace a standard Edison screw light bulb that may be used with a standard Edison screw socket.

Figure 7:
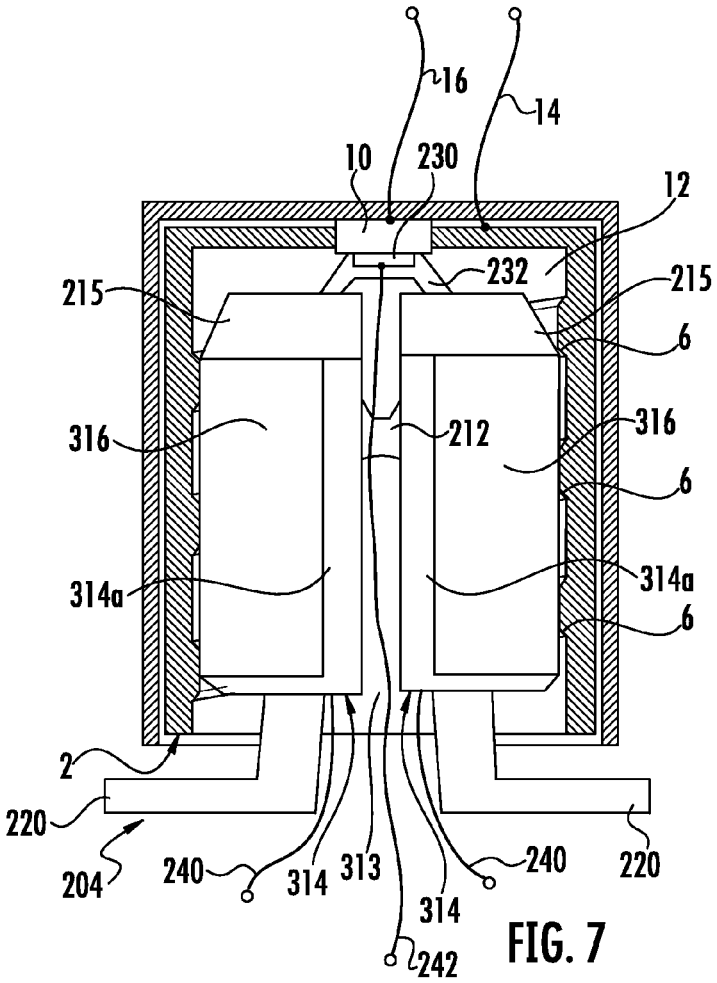
FIG. 7 is a side view of still another embodiment of the connector of FIG. 4 mounted in an exemplary socket.
Figure 8:
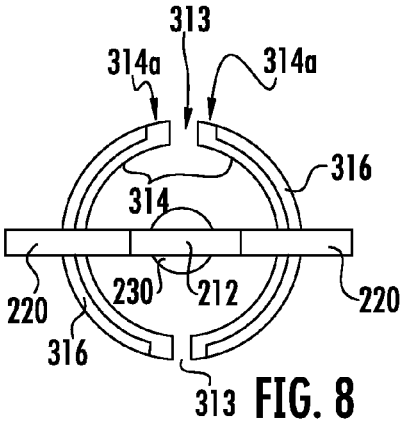
FIG. 8 is a top view of the connector of FIG. 7.
Figure 9:
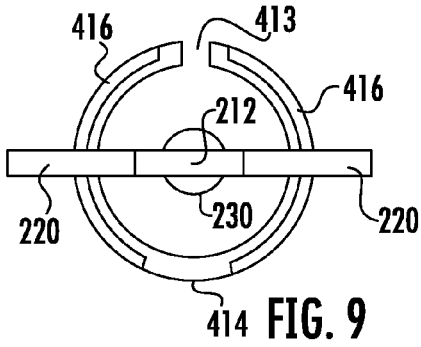
FIG. 9 is a top view of another embodiment of the connector of FIG. 7.
Figure 10:
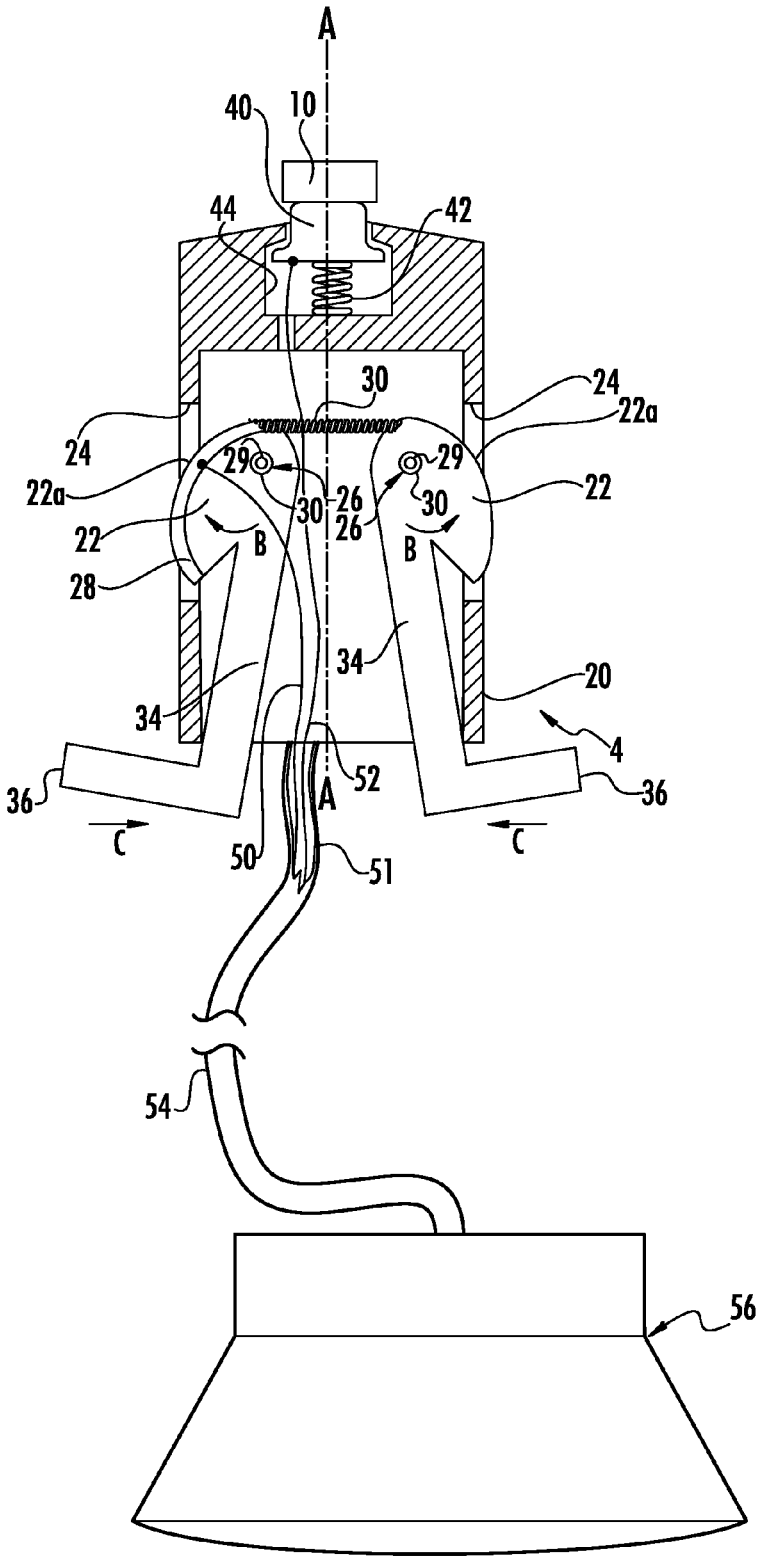
FIG. 10 is a partial section view of the connector of FIG. 1 without the exemplary socket.
Figure 11:
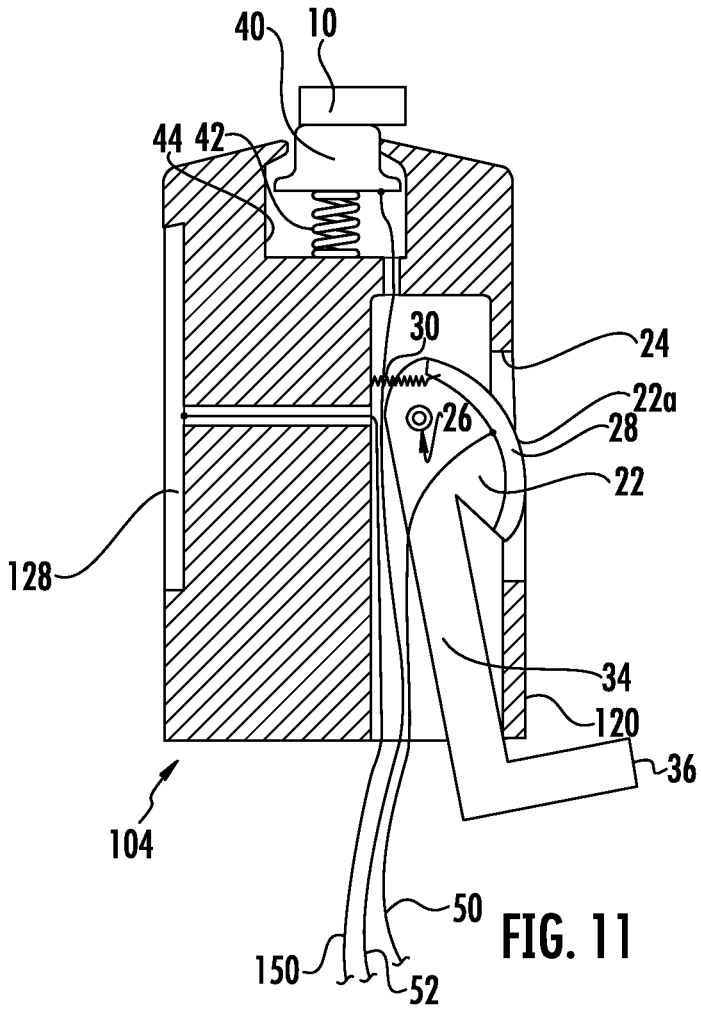
FIG. 11 is a partial section view of the embodiment of the connector of FIG. 3 without the exemplary socket.
Figure 12:
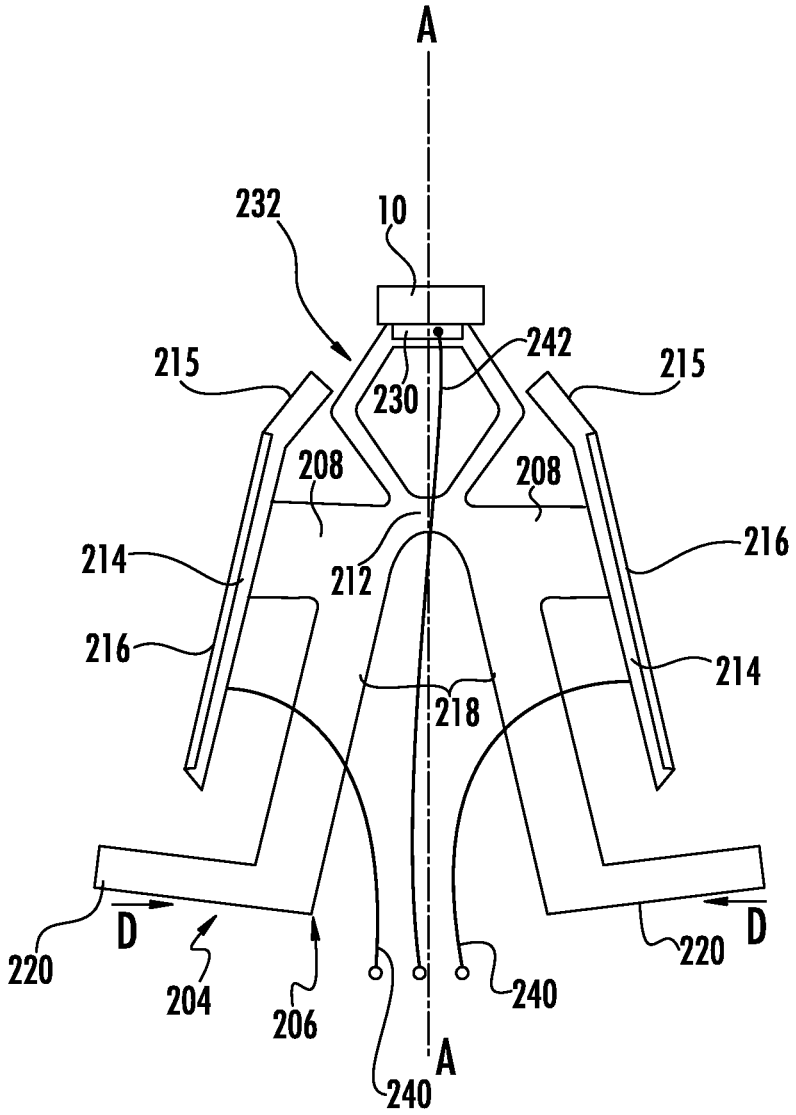
FIG. 12 is a side view of the embodiment of the connector of FIG. 4 without the exemplary socket.
Figure 13:
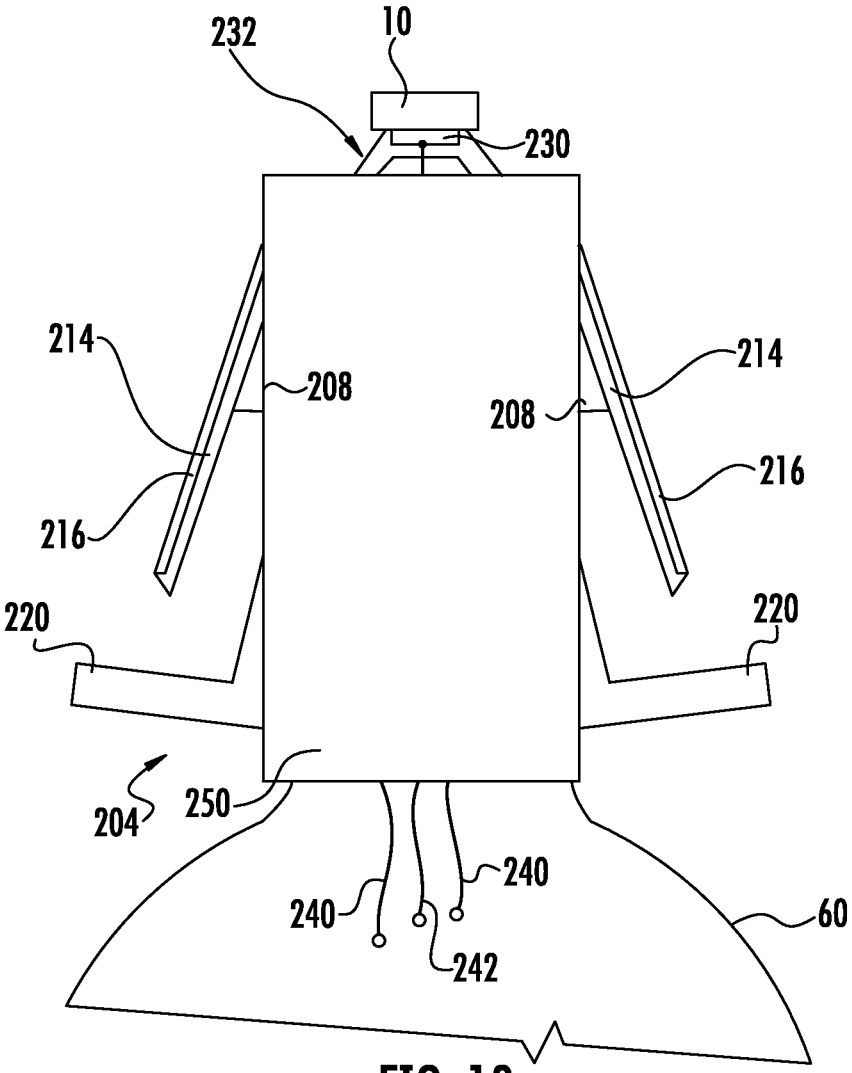
FIG. 13 is a side view of the embodiment of the connector of FIG. 5 without the exemplary socket.
Figure 14:
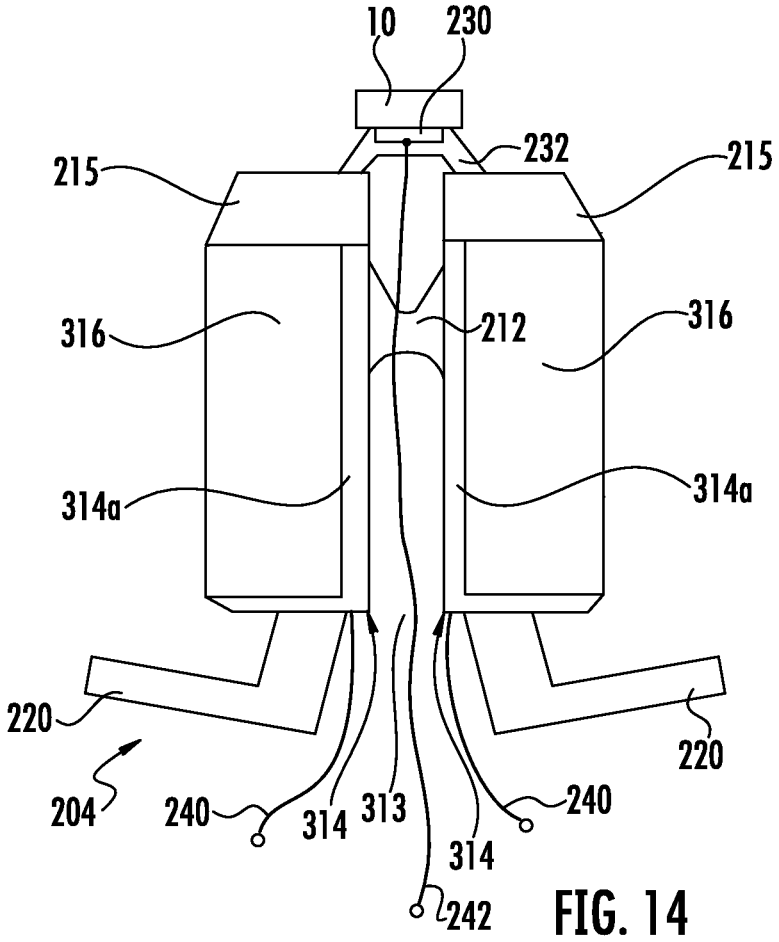
FIG. 14 is a side view of the embodiment of the connector of FIG. 7 without the exemplary socket.

Another embodiment of the connector of the invention is shown in FIGS. 7, 8 and 9 where like reference numerals are used to identify components previously described with reference to FIGS. 1, 2 and 4. In the embodiment of FIGS. 7 through 9 the plates 314 have a curved shape that together define a substantially cylindrical contact surface 314*a* for engaging the interior wall of the socket 2. In one embodiment the plates 314 extend for substantially the entire circumference of the socket and are separated by gaps 313, FIG. 8. When the plates 314 engage the inner wall of the socket 2 the force generated by the plates 314 on the socket is spread over the entire surface of the socket such that the connector is less likely to deform the socket when compared to a smaller plate such as described in the embodiment of FIG. 5. Moreover, the electrical contact 316 on the plate may also be expanded to extend over a larger portion of the interior surface of the socket. Such an arrangement may be beneficial with sockets where the entire inner surface of the socket is not electrically conductive and the socket uses a smaller contact located within the socket. Another arrangement of the plate is shown in FIG. 9 where the plate 414 is a single substantially annular plate having a single gap 413 to create a substantially C-shaped pad 414. Because the plate 414 is made of an elastic material the cam arms 208 are able to deform the pad to expand the gap 413 and force the exterior surface of the pad into engagement with the interior surface of the socket 2.

A first electrical conductor 240 is connected to the first electrical contact 316 and a second electrical conductor 242 is connected to the second electrical contact 230. The first electrical conductor 240 and the second electrical conductor 242 may form a pig tail that is connected to a light source to create a lighting system as shown in FIG. 1. In one preferred embodiment the light source is an LED light although any lighting technology may be used. In use the plug is inserted into a socket and the light source may be mounted in a ceiling or otherwise.

Alternatively, the connector of FIG. 7 may form an integrated light source. In this embodiment the bulb is fixed to the connector with the conductors extending directly to the light element in the bulb as shown in FIG. 5. The light element may be an LED package, incandescent element, or other light producing technology. Intervening elements may be disposed between the socket and the bulb such as heat sinks, power supplies or the like. To attach the connector to a bulb the connector may be held in a housing such as described with reference to FIG. 5 to provide a mounting structure for the bulb.

To mount a light fixture in a socket a connector as described above is connected to a light source. The actuator is manipulated to rotate the cam to the retracted position. The connector is inserted linearly into the socket. The actuator is released to allow the biasing mechanism to rotate the contact surfaces of the cam into engagement with the interior wall of the socket. To remove the light fixture the actuator is manipulated to rotate the cam to the retracted position. The connector is removed linearly from the socket. Upon release of the actuator the biasing mechanism rotates the contact surfaces of the cam to the extended position.

While the connector of the invention has been described with respect to an Edison screw socket the connector may be used with any type of light socket provided that the contacts on the connector are able to electrically contact the contacts on the socket. For example, in a bi-pin socket the contact pad of the embodiment of FIG. 1 may be replaced with a pair of pins that engage the two pin receptacles in the socket.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A connector for a light source comprising:

a housing dimensioned to fit into an electrical socket;

a first cam having a contact surface mounted for movement relative to the housing such that the contact surface is extended and retracted relative to the housing;

an electrical contact mounted on at least one of the housing and the first cam positioned to contact an electrical terminal in the socket;

a conductor electrically coupled to the electrical contact, the conductor being connected to a light source.

2. The connector of claim 1 wherein the housing is made of an electrically insulating material.

3. The connector of claim 1 further comprising a second cam having a second contact surface mounted for movement relative to the housing such that the second contact surface is extended and retracted relative to the housing.

4. The connector of claim 3 wherein the second cam is mounted 180 degrees from the first cam.

5. The connector of claim 1 wherein the first cam is mounted in the housing for pivoting motion about an axis and the contact surface is eccentric relative to pivot axis such that when the first cam pivots in a first direction the contact surface extends progressively farther away from the housing.

6. The connector of claim 5 further comprising a biasing mechanism that biases the contact surface in the first direction.

7. The connector of claim 5 further comprising an actuator for rotating the cam in a second direction opposite to the first direction.

8. The connector of claim 1 wherein the electrical contact is formed as a pad of electrically conductive material that is secured to the cam and forms at least a part of the contact surface.

9. The connector of claim 1 further comprising a second electrical contact supported by the housing and positioned to contact a second electrical terminal on the socket.

10. The connector of claim 9 further comprising a biasing mechanism for biasing the second electrical contact away from the housing.

11. The connector of claim 9 further comprising a second conductor electrically coupled to the second electrical contact, the second conductor being connected to the light source.

12. The connector of claim 1 wherein the first conductor is connected to the light source by a pigtail.

13. The connector of claim 1 wherein the first conductor is connected to a bulb integrated with the connector.

14. A method of mounting a light fixture in a socket comprising:

providing a connector connected to a light fixture, the connector including a cam movable between a retracted position and an extended position, the connector having at least one electrical contact positioned for contacting a terminal in the socket, an actuator for rotating the cam to the retracted position and a biasing mechanism for biasing the cam to the extended position;

manipulating the actuator to move the cam to the retracted position;

inserting the connector linearly into the socket; and releasing the actuator.

* * * * *